US005273185A

United States Patent [19]

Sacarto

[11] Patent Number: 5,273,185

[45] Date of Patent: Dec. 28, 1993

[54] ADJUSTABLE THRESHOLD FIRING APPARATUS FOR EMERGENCY BREATHING DEVICE

[76] Inventor: Walter E. Sacarto, 1294 S. Lincoln St., Denver, Colo. 80210

[21] Appl. No.: 935,498

[22] Filed: Aug. 24, 1992

[51] Int. Cl.[5] ..... B67D 5/00

[52] U.S. Cl. ..... 222/5

[58] Field of Search ..... 222/5, 6

[56] References Cited

U.S. PATENT DOCUMENTS

| | | | |
|---|---|---|---|
| 4,356,936 | 11/1982 | Legris | 222/5 |
| 4,475,664 | 10/1984 | Mackal | 222/5 |
| 4,482,081 | 11/1984 | Meggs | 222/5 |
| 4,500,014 | 2/1985 | Zimmerly | 222/5 |
| 4,946,067 | 8/1990 | Kelsall | 222/5 |
| 5,027,977 | 7/1991 | Kay et al. | 222/5 |

*Primary Examiner*—Kevin P. Shaver
*Attorney, Agent, or Firm*—J. Preston Oxenham

[57] ABSTRACT

A firing apparatus includes a firing pin on a longitudinal axis and biasing means to urge the pin in a firing direction. A central trigger body with a pull end and base end extends along the axis and includes a fruste-conical surface surrounding the axis and expanding toward the base end to a base edge. An outer trigger body includes a base portion having a sheath with an inner cylindrical surface surrounding the inner body and extending to a base edge. Cooperating screw threads on the inner and outer bodies allow adjustment of the bodies longitudinally, one relative to the other, such that the inner and outer base edges are separated by a selected longitudinal distance. A sear for restraining the firing pin has a head with a face abutting the fruste-conical surface and a back surface opposing the cylindrical surface such that, only when a sufficient longitudinal pulling force is exerted upon the trigger body, the sear head is squeezed between the base edges to release the trigger body from the sear, displacing the head away from the axis and thereby freeing the firing pin to move in the firing direction.

16 Claims, 3 Drawing Sheets

ADJUSTABLE THRESHOLD FIRING APPARATUS FOR EMERGENCY BREATHING DEVICE

TECHNICAL FIELD

The present invention relates to activation triggering apparatus. More particularly, the present invention relates to firing apparatus for emergency devices activated by release of high pressure gas from a high pressure gas storage canister. Most particularly, the present invention relates to such apparatus for an emergency breathing device which stores breathing air in a sealed high pressure air storage canister.

BACKGROUND OF THE INVENTION

Emergency breathing equipment gives victims of accidents and disasters a personal supply of breathing air to allow them to escape to safety. It may also be utilized by rescue personnel attempting to reach and assist such victims. Such equipment may be utilized in circumstances requiring escape from a submerged vehicle or where breathing air is contaminated by smoke from combustion or release of a dangerous gas. Such apparatus may be placed, for example, aboard aircraft making long over water passages and in small remote work areas where there is a present danger of fire or release of a dangerous gas.

Emergency breathing equipment of the prior art has generally included large, cumbersome gas bottles in which air is stored at moderate pressures of the order of 2,000 psi. In these devices, air is released from the bottle by activation of a valve. Thus, the bottles of such devices are not sealed and, as the valves may leak, the bottles must be checked from time to time, before each flight in the case of equipment utilized aboard aircraft, to assure adequate air pressure for proper operation.

Recently, emergency breathing devices utilizing small sealed air canisters storing air at higher pressures than previous equipment, of the order of 4,000 to 4,500 psi have been suggested. To be acceptable and effective, these devices require a firing mechanism which is compact, reliable and reusable and which provides for adjustment of the threshold force required to initiate breaking of the air canister seal and for lock-up of the firing mechanism to prevent unintentional breaking of the seal.

DISCLOSURE OF THE INVENTION

An object of the present invention is to provide a firing apparatus for an emergency breathing device which is reliable and easy to use yet is not likely to be set off inadvertently.

It is an object of the present invention to provide a firing apparatus that will allow adjustment of the threshold effort required to activate the device and allow for lock-up of the device to prevent firing.

It is a further object to provide an apparatus that is reusable and will allow the device to be readily rearmed and returned to service after use.

It is also an object to provide an apparatus which is durable and will stand up to repeated reuse for training purposes.

It is yet a further object to provide an apparatus which requires minimum maintenance and will remain reliable and operable during long periods without use.

In keeping with the above objectives, an emergency breathing device comprising an embodiment of the present invention includes a firing pin biased by a spring to move in a firing direction. A sear has a foot with a toe portion which abuts a shoulder on the surface of the pin and a heel portion which rests in a seat to restrain the pin from movement in the firing direction so long as the sear and the pin remain in their respective cocked positions.

A central trigger body has a center bore sized to slidingly receive a back end portion of the firing pin and a base portion with a frusto-conical surface having an axis coincident with that of the bore and expanding outward toward a base edge. An outer trigger body surrounds the central trigger body and has a base portion with a sheath having an inner cylindrical surface surrounding and set apart from the central trigger body and extending to a base edge. The central trigger body and outer trigger body have cooperating screw threads which allow adjustment of trigger body geometry by rotation of the central and outer trigger bodies relative to one another about their central axis to move the base edge of the sheath longitudinally relative to the base edge of central frusto-conical surface to select the distance along the central axis by which they are separated.

The sear has a head portion attached to the foot portion by a shank with a right angle bend such that, when the sear is in its cocked position and the trigger body is in its armed position, a face of the head portion abuts the frusto-conical surface of the central trigger body. With the sear in this position, the sheath of the outer trigger body portion may be adjusted to cover a back surface of the head. A pull ring is mounted on a cap of the trigger body, opposite the base end of the trigger body, on which a pulling force can be exerted tending to squeeze the sear head between the frusto-conical surface and the inner sheath surface to release the trigger body from restraint by the sear. The threshold force required to release the trigger body is dependent on the adjusted relative longitudinal position of the central and outer trigger bodies and the resulting longitudinal separation of the central body base edge and the outer body base edge. If there is no longitudinal separation between the edges, the trigger body cannot be pulled free. When the trigger body is pulled free, the conical surface of the central trigger body displaces the sear head lifting the sear toe from abutment with the firing pin shoulder and releasing the pin to move in the firing direction.

A striking end portion of the firing pin is located within a passage with a threaded end portion for receiving and mounting a high pressure air canister. When released by the sear, the pin pierces a sealing cap of the canister allowing high pressure air within the canister to escape into the passage. The pin is then driven backward to its cocked position by the high pressure gas and retained in that position by the sear, which is biased to its cocked position.

The base of the central trigger body has a longitudinal slot passing through the frusto-conical surface which is sufficiently large to allow the trigger body to be passed over the head of the sear. The trigger body is then rotated about the back end of the firing pin to move the slot out of alignment with the sear head. A spring-pin lock is provided to retain the trigger in a rotational position in which the slot is not aligned with the sear head.

Other objects, advantages and aspects of the invention will become apparent upon reading of the following detailed description and claims and upon reference to the accompanying drawings.

DETAILED DESCRIPTION OF THE INVENTION

Figure 1:
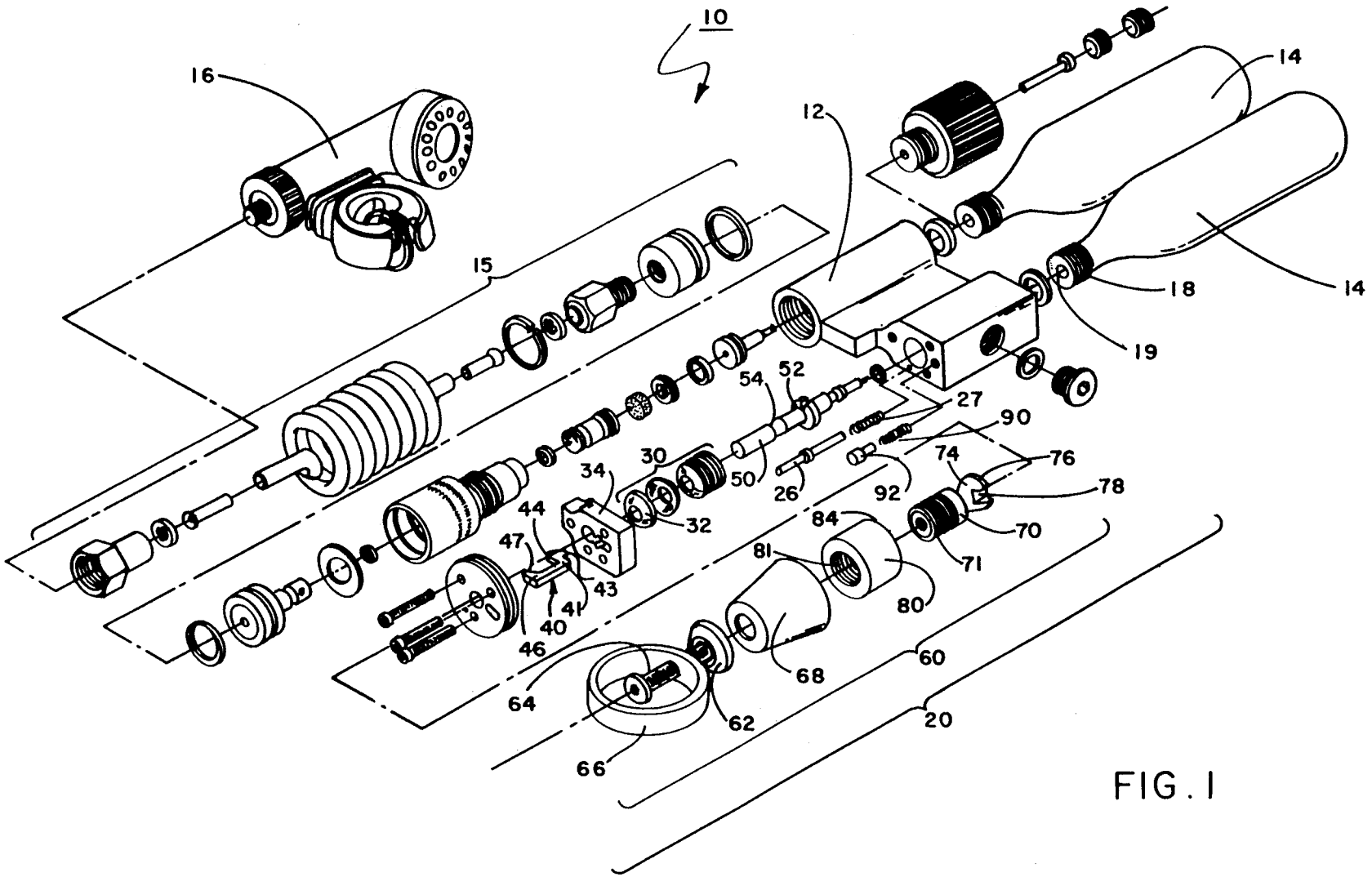
FIG. 1 is an isometric, exploded view of an emergency breathing device comprising a preferred embodiment of the present invention.
Figure 2:
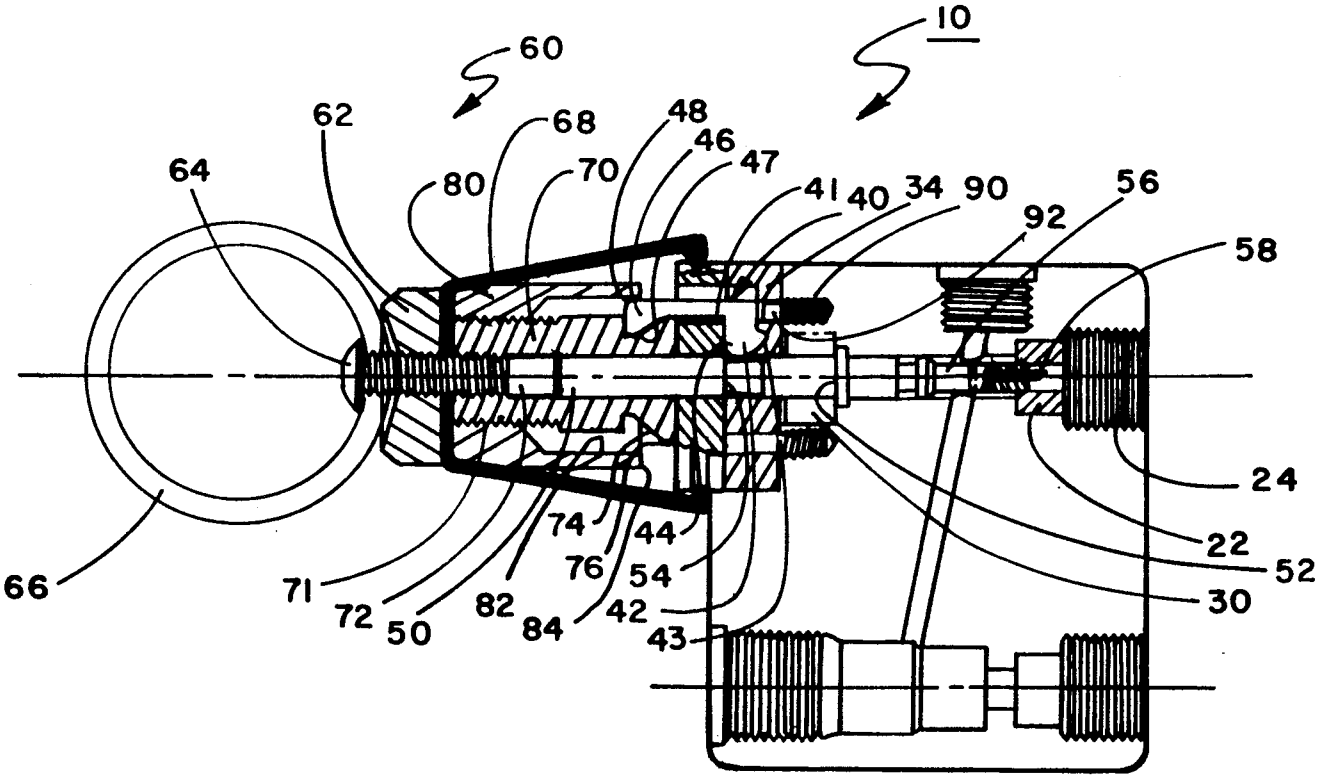
FIG. 2 is a sectional view, partially in schematic, of the emergency breathing device of FIG. 1, showing the sear, firing pin and trigger in a cocked and armed configuration.
Figure 3:
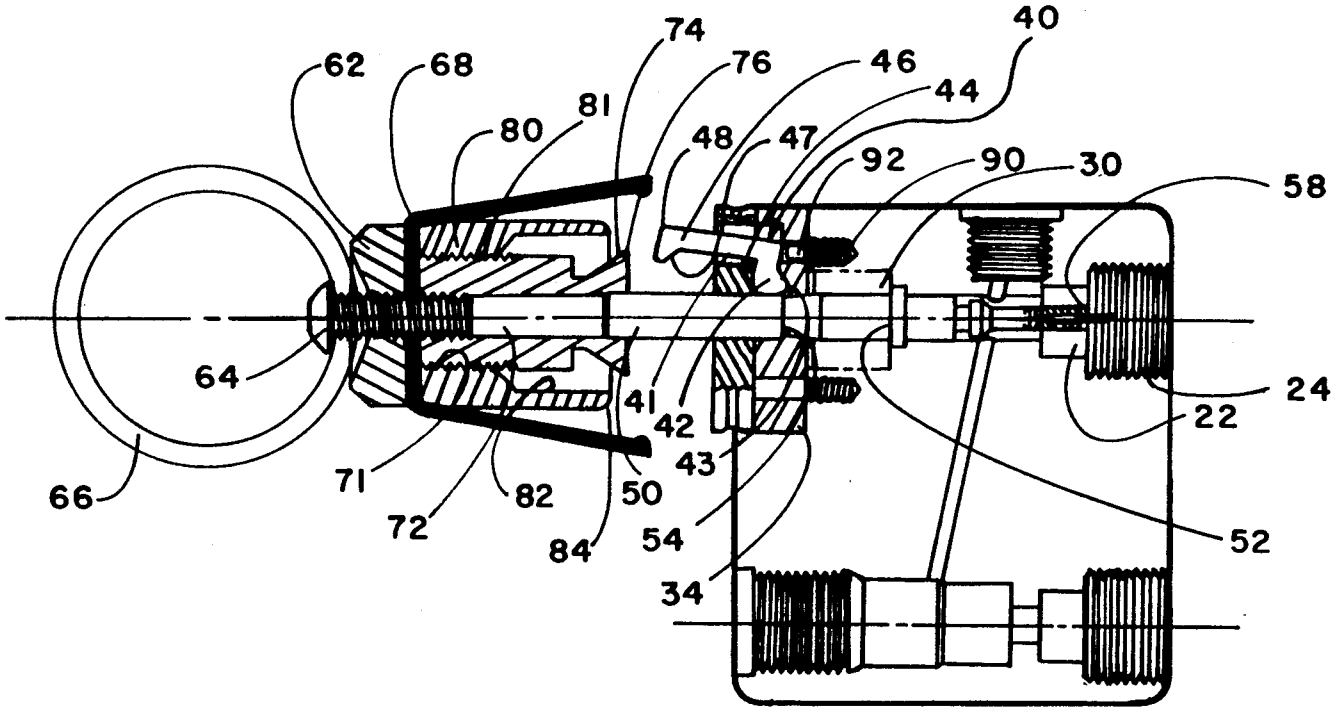
FIG. 3 is a sectional view, partially schematic, of the emergency breathing device of FIG. 1, showing the sear, firing pin and trigger in a configuration just after firing.

An isometric, exploded view of emergency breathing device 10 comprising a preferred embodiment of the present invention is shown in FIG. 1. Emergency breathing device 10 generally includes housing 12, high pressure air canisters 14, air supply tube 15, mouth piece 16, and firing assembly 20. Canisters 14 are similar to those utilized to hold gases for inflation of emergency devices. After being filled with high pressure gas, for example at 4,000 to 4,5000 psi, canisters 14 are sealed with cap 19 at threaded end 18. Breathing device 10 is shown assembled in the sectional drawing of FIG. 2, which is partially in schematic so that firing assembly 20 of breathing device 10 can more easily be seen and understood. FIG. 2 shows sear 40, firing pin 50 and trigger assembly 60 in a cocked and armed configuration. FIG. 3 is similar to FIG. 2, but shows sear 40, firing pin 50 and trigger 60 in a configuration just after firing.

As can be seen is FIG. 2, in a cocked configuration, firing pin 50 is biased by compressed firing spring 30 to move in a firing direction, to the right as shown in that figure. As seen in FIG. 1, firing spring 30 of the exemplary preferred embodiment is assembled of frusto-conical washers 32 surrounding firing pin 50 and stacked in alternate longitudinal orientation so that washers 32 are compressed between housing top block 34 and spring stop 36 of firing pin 50. Sear 40 includes foot portion 42 with heel portion 43 and toe portion 44. As seen in FIG. 2, when in the cocked position, sear 40 is held in place, with heel 43 resting in seat 36 formed in the top of housing 12 and toe 44 abutting shoulder 54 of firing pin 50, by the biasing force of spring 30. Thus, the biasing force is transmitted to seat 36, preventing movement of firing pin 50 in the firing direction. Abutting surfaces of toe 44 and shoulder 52, and of heel 42 and seat 36, are preferably nesting cylindrical surfaces such that the biasing force of spring 30 is distributed over their surface area and high pressure points are avoided.

Trigger assembly 60 includes central trigger body 70 and outer trigger body 80. Central trigger body 70 has center bore 72 and a base portion with frusto-conical surface 74 extending outwardly to base edge 76. Outer trigger body 80 has a base portion including a sheath with inner cylindrical surface 82 surrounding and set apart from central trigger body 70 and extending to base edge 84. Central trigger body 70 and outer trigger body 80 are provided with cooperating screw threads 71 and 81, respectively, such that the relative longitudinal position of central trigger body 70 and outer trigger body 80, and thus the longitudinal distance separating base edges 84 and 76, can be adjusted by rotating central trigger body 70 and outer trigger body 80, one relative to the other. Trigger assembly 60 further includes locking cap 62 which can be drawn down by tightening locking screw 64 to lock central trigger body 70 and outer trigger body 80 in selected relative longitudinal relation. In the preferred embodiment of FIG. 2, locking screw 64 also attaches pull ring 66 to the pulling end of trigger assembly 60, and flexible dust cover 68 is clamped between locking cap 62 and the trigger body to protect against dust when firing assembly 20 of emergency breathing device 10 is in a cocked and armed configuration.

When firing assembly 20 of emergency breathing device 10 is in a cocked and armed condition, as illustrated in FIG. 2, central trigger body 70 is positioned with the back end of firing pin 50 in bore 72 and base edge 76 abutting housing top block 34. In this position, frusto-conical surface 74 abuts face 47 of head 46 of sear 40. In FIG. 2, the relative longitudinal position of outer trigger body 80 and central trigger body 70, and thus the relative longitudinal position of base edge 84 to base edge 76, is shown adjusted such that inner surface 82 of outer trigger body 80 partially covers back surface 48 of sear 40. In this cocked and armed configuration, when a pulling force is exerted on pull ring 66, to the left as shown in FIG. 2, trigger assembly 60 will be retained adjacent housing top block 34 until the pulling force is sufficient to squeeze head 46 between edges 84 and 76. As shown in FIG. 3, once sufficient pulling force is exerted on the ring, as trigger assembly 60 is released and pulled free, frusto-conical surface 74 of central trigger body 70 acts against face 47 of head 46 to displace head 46 upward, as shown in FIG. 2, lifting toe portion 44 of sear 40 from abutment with shoulder 54 of firing pin 50 and allowing the biasing force of spring 30 to drive the pin in the firing direction.

In the preferred embodiment, striking end 56 of firing pin 50 is provided with piercing element 58 and lies in pin passage 22 which is sized to slidingly receive end 56. Pin passage 22 is provided with threads 24 to receive and cooperate with threaded end 18 of canister 14 and retain canister 14 in position at the end of the passage with sealing cap 19 facing piercing element 58 of firing pin 50. When canister 14 is in position at the end of passage 22 and pin 50 is driven in the firing direction by spring 30 piercing sealing cap 19 high pressure gas from the canister is released into passage 22. Pin 50 and passage 22 of the preferred embodiment are of sufficient cross section area that the pressure of gas initially released from the canister will create sufficient force to overcome the biasing force of spring 30 and return firing pin 50 to its cocked position. When pin 50 returns to the cocked position, a biasing force provided against shank 41 of sear 40 by spring 90, acting through biasing member 92, returns sear 40 to its cocked position to again restrain pin 50 from movement in the firing direction.

The threshold pressure required to pull trigger assembly 60 free of head 46 of sear 40 may be adjusted by adjusting the relative longitudinal position of outer trigger body 80 relative to central trigger body 70. When outer trigger body 80 is moved sufficiently to the left, as shown in FIG. 2, such that surface 82 does not cover any of back surface 48 of sear head 46, very little force will be required to pull trigger assembly 60 to the left and cause emergency breathing device 10 to fire. Alternatively, when outer trigger body 80 is moved sufficiently to the right, as shown in FIG. 2, for example, until edge 84 is brought into contact with housing top block 34, such that surface 82 covers a large area of back surface 48 of sear head 46, trigger assembly 60 is effectively locked and cannot be pulled away from housing top block 34. Thus, the firing assembly of the exemplary preferred embodiment may be adjusted to require any threshold pulling force desired for activation of breathing device 10, from a hair trigger to fully locked.

The base of the central trigger body 70 has longitudinal slot 78 through frusto-conical surface 74 which is sufficiently large to allow trigger assembly 60 to be passed over head 46 of sear 40. Thus, breathing apparatus 10 may be rearmed for later use by replacing canisters 14 with new pressurized canisters, aligning slot 78 with sear head 76, passing trigger assembly 60 over sear head 46, and rotating trigger assembly 60 about the back end of firing pin 50 to move slot 78 out of alignment with sear head 46. In the preferred embodiment of FIG. 1, spring-pin 26 is urged into a cooperating hole in the base of central trigger body 70 to retain the trigger in a rotational position in which slot 78 is not aligned with sear head 46.

While an exemplary apparatus comprising a preferred embodiment of the present invention has been shown, it will be understood, of course, that the invention is not limited to that embodiment. Modification may be made by those schooled in the art, particularly in light of the foregoing teachings. For example, surface 74 may be a double curved rather that a ruled surface. Further, the firing apparatus of the present invention may be utilized in emergency equipment other than breathing apparatus which is activated by breaking a seal cap of a high pressure gas canister and, the release feature may be applied in any situation requiring an adjustable threshold release. It is, therefore, contemplated by the attached claims to cover any such modification which incorporates the essential features of this invention or encompasses the true spirit and scope of the invention.

I claim:

1. A firing apparatus comprising:

a firing pin extending along a longitudinal axis from a back end to a striking end;

biasing means for exerting a biasing force to urge said firing pin to move longitudinally in a firing direction from said back end toward said striking end;

a central trigger body extending along a longitudinal trigger axis from a pull end to a base end, and including a base portion with a frusto-conical surface surrounding said axis and expanding outward toward a base edge at said base end;

an outer trigger body surrounding said trigger axis and extending from a pull end to a base end and including a base portion with a sheath having an inner cylindrical surface surrounding and set apart from said center trigger body and extending to a base edge;

adjustable trigger body geometry fixing means for adjustably fixing said outer trigger body in a selected longitudinal position relative to said central trigger body to form a trigger body such that said frusto-conical base edge and said sheath base edge are separated by a selected distance along said longitudinal axis;

a sear for restraining said firing pin from movement in said firing direction when said sear and said firing pin are each in a cocked position, said sear having a head portion with a face surface abutting said frusto-conical surface and a back surface within a radial distance of said trigger axis not greater than a radius of said cylindrical surface such than said outer trigger body can be longitudinally adjusted to cause said sheath to cover a portion of said back surface; and, means for allowing a longitudinal pulling force to be exerted upon said trigger body tending to squeeze said sear head between said frusto-conical surface and said sheath cylindrical surface and release said trigger body from said sear.

2. A firing apparatus as in claim 1 in which said trigger body fixing means comprises screw threads formed on an external surface of said central trigger body and cooperating screw threads formed on an inner surface of said outer trigger body such that said central trigger body and said outer trigger body may be rotated about said body axis, one relative to the other, to determine said selected distance.

3. A firing apparatus as in claim 1, further comprising said base portion includes a longitudinal slot formed through said frusto-conical surface, said slot sufficiently large to allow said head portion of said shear to pass therethrough and said trigger body is rotatable about said trigger axis such that said trigger body may be passed over said head and rotated to bring said face surface into abutment with said conical surface.

4. A firing apparatus as in claim 3, further comprising means for fixing the rotational position of said trigger body about said trigger body axis such that said channel is not in alignment with said head.

5. A firing apparatus as in claim 4, in which said central trigger body surrounds a central bore having an axis coincident with said trigger axis and sized to slidingly receive said firing pin and said back end of said pin protrudes from said housing such that a back end portion of said pin serves to locate said trigger body.

6. A firing apparatus as in claim 1, in which said sear is displaced from said cocked position by displacement of said face by said frusto-conical surface when said trigger body is released.

7. A firing apparatus as in claim 6, further comprising biasing means for urging said sear into the cocked sear position when said firing pin is in said cocked pin position.

8. A firing apparatus as in claim 7, further comprising:

a housing defining a firing pin passage extending in the firing direction from a pin end to a canister end;

means for mounting a high pressure gas containment canister at said canister passage end; and, said striking end of said firing pin includes piercing means for piercing a canister of high pressure gas such that, when a canister containing gas at high pressure is mounted in said mounting means and said sear is displaced from said cocked sear position, said firing pin travels in the firing direction to pierce the canister.

9. A firing apparatus as in claim 8, in which said pin passage includes a passage portion which closely surrounds a portion of said firing pin and said firing pin portion is of a cross section area sufficiently large that, when gas is released from the canister, a pressure of escaping gas within the pin passage acting upon said cross section area creates a force sufficient to urge said pin in a return direction in opposition to said pin biasing force and into said cocked pin position.

10. A firing apparatus as in claim 1, in which said pin biasing means comprises a stack of frusto-conical washers.

11. A firing apparatus as in claim 1, in which said sear includes a foot portion with a heel and toe portion and said firing pin has a shoulder formed in its outer surface and further comprising a seat for supporting said heel portion such that, when said firing pin and said sear are in respective cocked positions, said toe abuts said shoulder and said firing pin biasing force is transmitted by said shoulder through said foot to said seat.

12. A firing apparatus as in claim 11, in which said toe includes a cylindrical surface and said shoulder includes a cylindrical surface in which said toe surface is nested when said pin and said sear are cocked position and, said heel includes a cylindrical surface and said seat includes a cylindrical surface in which said toe surface is nested when said pin and said sear are in cocked position and said seat is positioned relative to said shoulder such that said sear is supported in said cocked sear position by said pin biasing force when said pin is in said cocked pin position.

13. A firing apparatus as in claim 12, further comprising biasing means for urging said sear into the cocked sear position when said firing pin is in said cocked pin position.

14. A firing apparatus as in claim 13, in which said sear is displaced from said cocked position by displacement of said face by said frusto-conical surface when said trigger body is released.

15. A firing apparatus as in claim 14, in which said sear includes a shank portion joining said head and foot portions said shank portion having a generally right angle bend between a head shank portion and a foot shank portion and said sear biasing means includes a spring and biasing member which abuts said foot shank portion and exerts a biasing force generally in alignment with a longitudinal axis of said head shank portion.

16. A release device for releasing a body to move in a predetermined direction only in response to a force greater than an adjustable predetermined threshold force comprising:

an extension extending from the body in a direction generally opposite the predetermined direction and having a surface extending to a distal edge, the surface generally at an angle to the predetermined direction and facing the body;

an adjustable extension member extending from the body in an extension direction generally opposite the predetermined direction, said extension direction intercepting a plane of said surface, to a distal end, said adjustable member including means for adjusting a distance between the body and said distal end to an adjusted distance; and, a retention member with a shank extending generally in the predetermined direction from a generally fixed base and reaching between said distal edge and said distal end to a resilient head portion, said head portion having a dimension larger than a distance between said distal edge and said distal end such that said body is restrained from moving in the predetermined direction unless acted upon by a force sufficient to cause said head portion to squeeze between said distal edge and said distal end such that the adjustable, predetermined threshold force is determined by said adjusted distance.

* * * * *